US010520292B1

(12) United States Patent
Westhafer

(10) Patent No.: US 10,520,292 B1
(45) Date of Patent: Dec. 31, 2019

(54) MAGAZINE HOLSTER FOR QUICK LOADING OF FIREARMS

(71) Applicant: Eric Wolfgang Westhafer, Westminster, CO (US)

(72) Inventor: Eric Wolfgang Westhafer, Westminster, CO (US)

( * ) Notice: Subject to any disclaimer, the term of this patent is extended or adjusted under 35 U.S.C. 154(b) by 0 days.

(21) Appl. No.: 16/167,967

(22) Filed: Oct. 23, 2018

Related U.S. Application Data

(60) Provisional application No. 62/579,034, filed on Oct. 30, 2017.

(51) Int. Cl.
*F42B 39/02* (2006.01)
*A45F 5/02* (2006.01)

(52) U.S. Cl.
CPC ..... *F42B 39/02* (2013.01); *A45F 5/021* (2013.01); *A45F 2200/0591* (2013.01)

(58) Field of Classification Search
CPC ..... Y10S 224/931; F42B 39/02; F42B 39/26; F41A 9/63; A45F 5/02; A45F 5/021; A45F 2200/0591
USPC ..... 224/271, 931, 242, 245
See application file for complete search history.

(56) References Cited

U.S. PATENT DOCUMENTS

| | | | | | |
|---|---|---|---|---|---|
| 4,799,323 | A * | 1/1989 | Musgrave | F41A 17/38 | 42/90 |
| 5,232,137 | A * | 8/1993 | Devine | A45F 5/02 | 222/175 |
| 5,460,346 | A * | 10/1995 | Hirsch | A45F 5/02 | 224/272 |
| 5,540,368 | A * | 7/1996 | Oliva | A45F 5/02 | 224/242 |
| 2010/0044405 | A1* | 2/2010 | Albert | A45F 5/02 | 224/666 |
| 2015/0182011 | A1* | 7/2015 | Mccrone | A45F 5/02 | 224/191 |

* cited by examiner

*Primary Examiner* — Adam J Waggenspack
(74) *Attorney, Agent, or Firm* — Plager Schack LLP; Mark H. Plager; Michael J. O'Brien

(57) ABSTRACT

A holster assembly is configured to detachably join a magazine to a waist of a user. The holster assembly includes an upper holster assembly further including an upper holster assembly internal channel, wherein the upper holster assembly internal channel is joined to the magazine. A tongue further includes a button wherein the button extends below a lower edge of the upper holster assembly internal channel. A lower holster assembly is detachably coupled to the upper holster assembly and includes a lower holster assembly internal channel. The lower holster assembly internal channel is immediately adjacent to the magazine. A tongue receiver has a tongue receiver opening. The tongue receiver opening extends above an upper edge of the lower holster assembly internal channel.

10 Claims, 4 Drawing Sheets

MAGAZINE HOLSTER FOR QUICK LOADING OF FIREARMS

RELATED APPLICATION

This application claims priority to provisional patent application U.S. Ser. No. 62/579,034 filed on Oct. 30, 2017, the entire contents of which is herein incorporated by reference.

BACKGROUND

The embodiments herein relate generally to a magazine holster for quick loading of firearms. Prior to the embodiments of the disclosed invention magazine or clip holstering systems are inefficient and hard to grab for the user. The system described here of magazine holster allows the user to insert magazines into their firearm quicker than most popular magazine or clip holstering systems. It allows for quick reloading by allowing the magazine or clip to hang from the user in a position more readily available to be inserted into a firearm than traditional magazine or clip holstering systems. The magazine holster does this by using several piece holstering systems held together via one or more quick release fasteners. Thus the embodiment described here solves the problem by reducing the effort and time required to reload the magazine or clip into the firearm.

SUMMARY

A holster assembly is configured to detachably join a magazine to a waist of a user. The holster assembly includes an upper holster assembly further including an upper holster assembly internal channel, wherein the upper holster assembly internal channel is joined to the magazine. A tongue further includes a button wherein the button extends below a lower edge of the upper holster assembly internal channel. A lower holster assembly is detachably coupled to the upper holster assembly and includes a lower holster assembly internal channel. The lower holster assembly internal channel is immediately adjacent to the magazine. A tongue receiver has a tongue receiver opening. The tongue receiver opening extends above an upper edge of the lower holster assembly internal channel.

In a first mode of operation, the tongue fits into the tongue receiver opening to join the upper holster assembly to the lower holster assembly. In a second mode of operation, depressing the button detaches the tongue from the tongue receiver opening to separate the upper holster assembly from the lower holster assembly.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
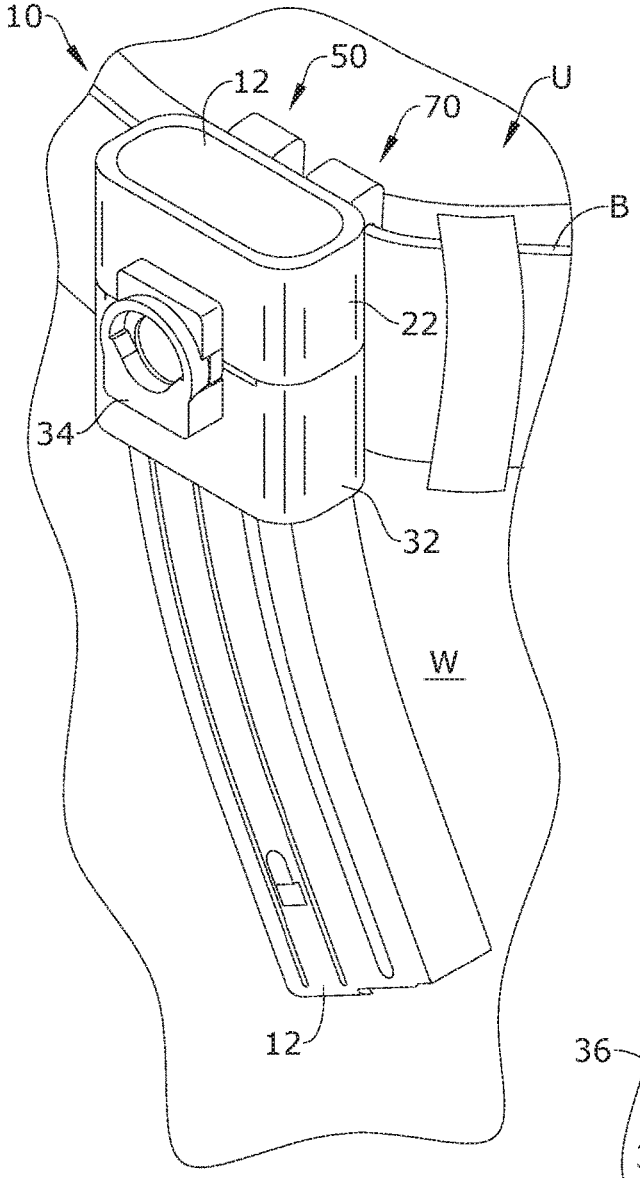
FIG. 1: is a perspective view of the invention, shown in use
Figure 2:
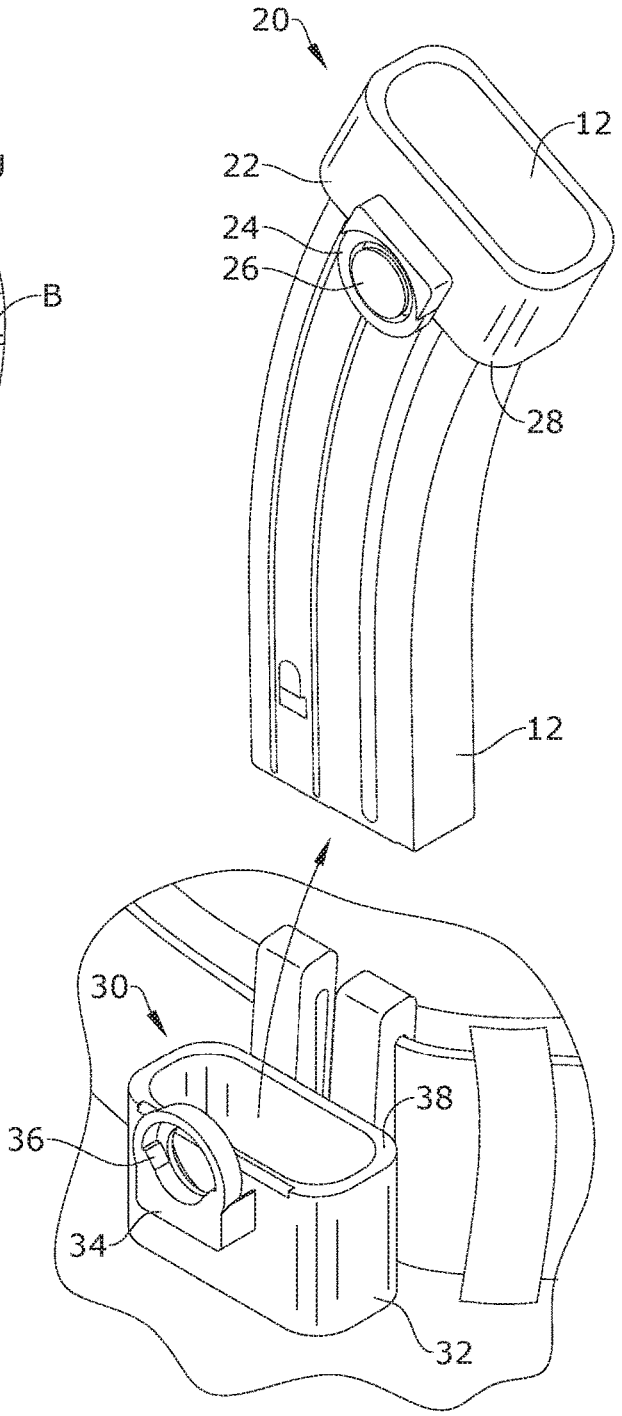
FIG. 2: is a perspective view of the invention, illustrating the easy release of magazine for quick loading with top part of the holster still attached
Figure 3:
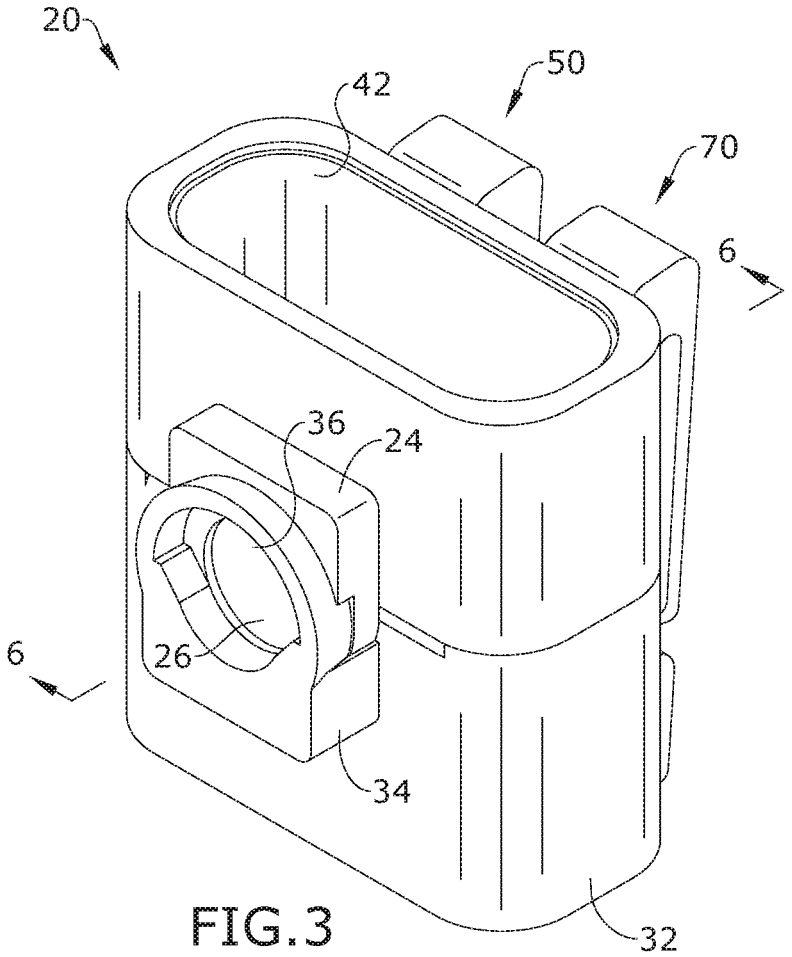
FIG. 3: is a perspective view of the invention assembly
Figure 4:
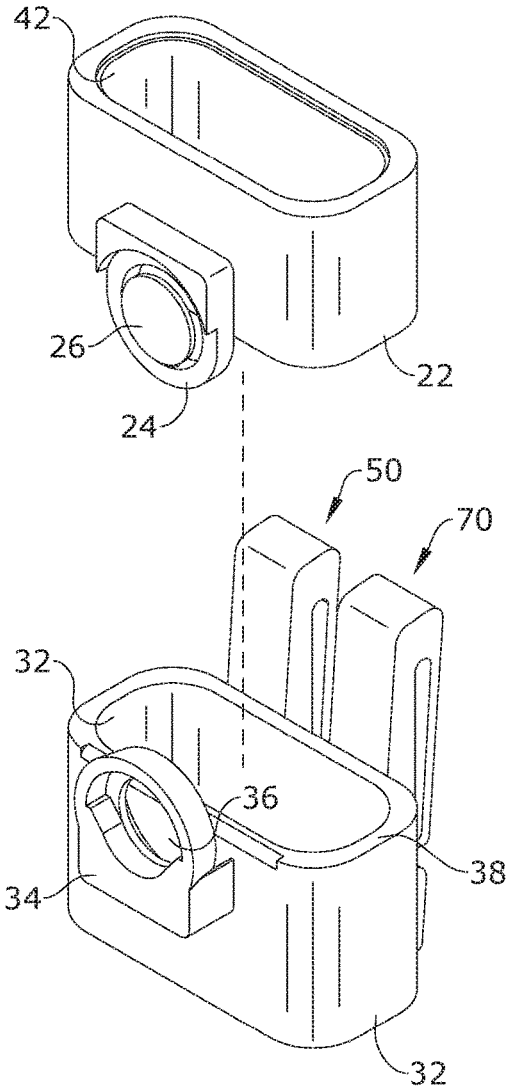
FIG. 4: is a top front exploded view of the invention
Figure 5:
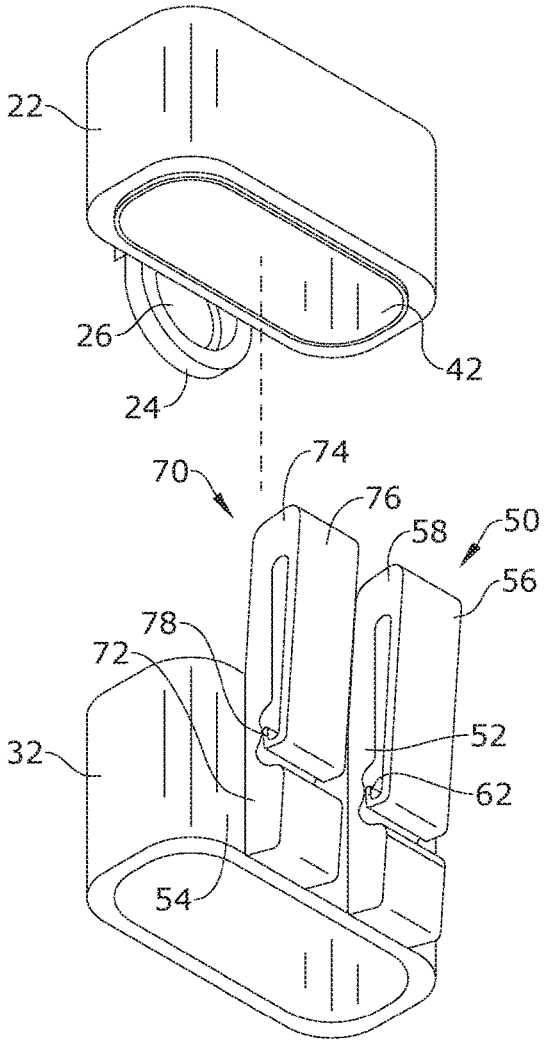
FIG. 5: is a rear bottom exploded view of the invention
Figure 6:
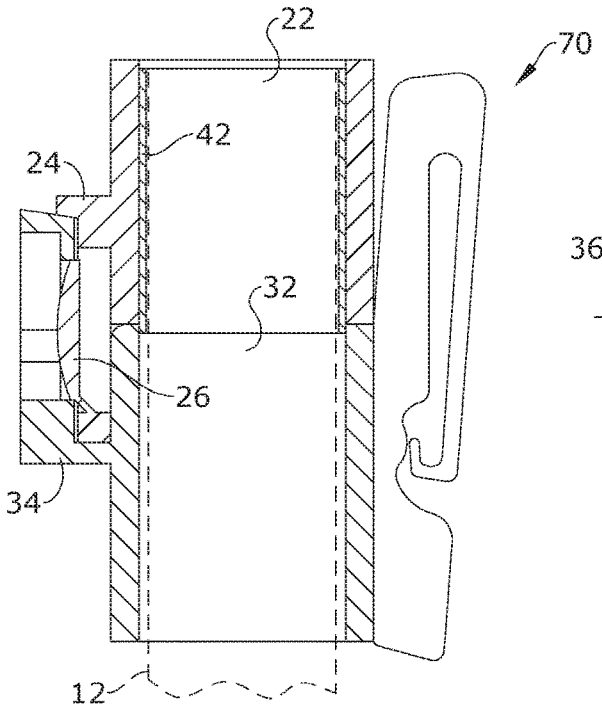
FIG. 6: is a section view of the invention, taken along line 6-6 in FIG. 3, with the placement of magazine shown in dashed lines
Figure 7:
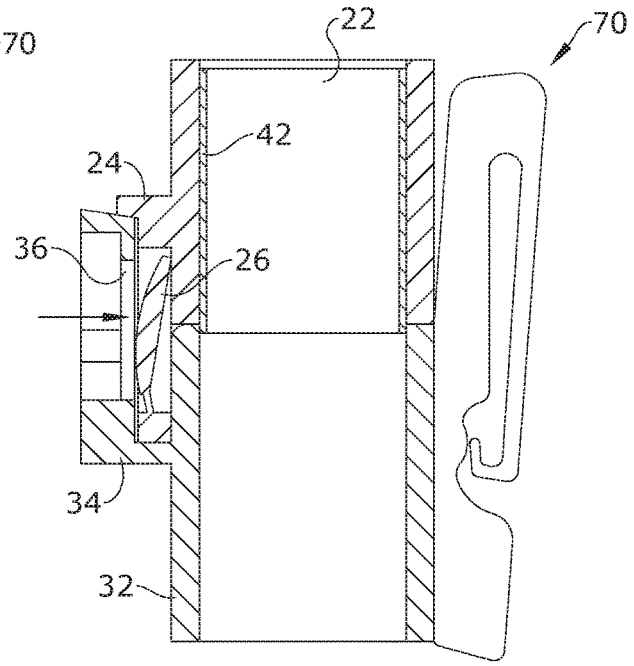
FIG. 7: is a section view of the invention, showing the depression of button
Figure 8:
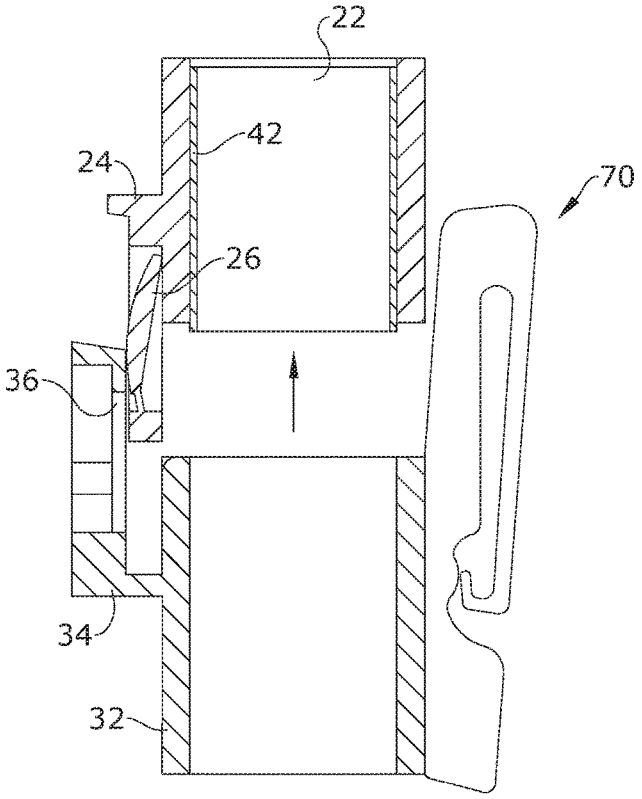
FIG. 8: is a section view of the invention, showing the removal of the top section of the holster from the bottom section of the holster.

In accordance with one embodiment of the disclosed invention, as shown in FIGS. 1-8, a holster assembly 10 is configured to detachably join a magazine 12 to a waist W of a user U. The holster assembly 10 comprises an upper holster assembly 20 further comprising an upper holster assembly internal channel 22. The upper holster assembly internal channel 22 is joined to the magazine 12.

A tongue 24 further comprises a button 26. The button 26 extends below a lower edge 28 of the upper holster assembly internal channel 22. A lower holster assembly 30 is detachably coupled to the upper holster assembly 20 and further comprises a lower holster assembly internal channel 32. The lower holster assembly internal channel 32 is immediately adjacent to the magazine 12. A tongue receiver 34 further comprises a tongue receiver opening 36. The tongue receiver opening 36 extends above an upper edge 38 of the lower holster assembly internal channel 32. In a first mode of operation, the tongue 24 fits into the tongue receiver opening 36 to join the upper holster assembly 20 to the lower holster assembly 30. In a second mode of operation, depressing the button 26 detaches the tongue 24 from the tongue receiver opening 36 to separate the upper holster assembly 20 from the lower holster assembly 30. In some embodiments, a rubberized coating 42 can line the upper holster assembly internal channel 22, joining the upper holster assembly 20 to the magazine 12.

In some embodiments a first clip 50 can further comprise a first clip attachment portion 52, joined to a rear side 54 of the lower holster assembly 30 and extending above the lower holster assembly internal channel 32. The first clip 50 can further comprise a first clip rounded portion 58 arranged on top of the first clip attachment portion 52. The first clip 50 can further comprise a first clip securement portion 56, substantially parallel to the first clip attachment portion 52 and joined to the first clip rounded portion 58. The first clip 50 can further comprise a first clip tooth 62, extending inward from the first clip securement portion 56 toward the first clip attachment portion 52. A belt B of a user U can fit between the first clip tooth 62 and the first clip attachment portion 52 to hold the magazine 12 at the waist W of the user U.

In some embodiments, a second clip 70 can further comprise a second clip attachment portion 72, joined to a rear side 54 of the lower holster assembly 30 and extending above the lower holster assembly internal channel 32 wherein the second clip attachment portion 72 is substantially parallel to the first clip attachment portion 52. The second clip 70 can further comprise a second clip rounded portion 74 arranged on top of the second clip attachment portion 72. The second clip 70 can further comprise a second clip securement portion 76, substantially parallel to the second clip attachment portion 72 and joined to the second clip rounded portion 74. The second clip securement portion 76 is substantially parallel to the first clip securement portion 56. The second clip 70 can further comprise a second clip tooth 78, extending inward from the second clip securement portion 76 toward the second clip attachment portion 72. The belt B of the user U can fit between the second clip tooth 78 and the second clip attachment portion 72 to hold the magazine 12 at the waist W of the user U.

The version of the invention discussed here can be made with impact resistant polymers and durable synthetic rubber. The polymer pieces are made to house or hold the rubber piece and the magazine or clip is inserted into the center of these components for a strong hold on the user. The polymers and the rubber must be mixed together in accordance with the specific dimensions the invention requires. The specific design of the components could be added to make the invention work better.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application. For example, a reference that is partially inconsistent is incorporated by reference except for the partially inconsistent portion of the reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A holster assembly, configured to detachably join a magazine to a waist of a user; the holster assembly comprising:

an upper holster assembly further comprising:

an upper holster assembly internal channel, wherein the upper holster assembly internal channel is joined to the magazine; and a tongue, further comprising a button wherein the button extends below a lower edge of the upper holster assembly internal channel;

a lower holster assembly, detachably coupled to the upper holster assembly, further comprising:

a lower holster assembly internal channel wherein the lower holster assembly internal channel is immediately adjacent to the magazine; and a tongue receiver further comprising a tongue receiver opening; wherein the tongue receiver opening extends above an upper edge of the lower holster assembly internal channel wherein a first mode of operation, the tongue fits into the tongue receiver opening to join the upper holster assembly to the lower holster assembly;

wherein a second mode of operation, depressing the button detaches the tongue from the tongue receiver opening to separate the upper holster assembly from the lower holster assembly.

2. The holster assembly of claim 1, further comprising: a rubberized coating lining the upper holster assembly internal channel, joining the upper holster assembly to the magazine.

3. The holster assembly of claim 1, further comprising: a first clip further comprising a first clip attachment portion, joined to a rear side of the lower holster assembly and extending above the lower holster assembly internal channel.

4. The holster assembly of claim 3, wherein the first clip further comprises, a first clip rounded portion arranged on top of the first clip attachment portion.

5. The holster assembly of claim 4, wherein the first clip further comprises, a first clip securement portion, substantially parallel to the first clip attachment portion and joined to the first clip rounded portion.

6. The holster assembly of claim 5, wherein the first clip further comprises a first clip tooth, extending inward from the first clip securement portion toward the first clip attachment portion; wherein a belt of a user fits between the first clip tooth and the first clip attachment portion to hold the magazine at the waist of the user.

7. The holster assembly of claim 6, further comprising: a second clip further comprising a second clip attachment portion, joined to a rear side of the lower holster assembly and extending above the lower holster assembly internal channel wherein the second clip attachment portion is substantially parallel to the first clip attachment portion.

8. The holster assembly of claim 7, wherein the second clip further comprises, a second clip rounded portion arranged on top of the second clip attachment portion.

9. The holster assembly of claim 8, wherein the second clip further comprises, a second clip securement portion, substantially parallel to the second clip attachment portion and joined to the second clip rounded portion; wherein the second clip securement portion is substantially parallel to the first clip securement portion.

10. The holster assembly of claim 9, wherein the second clip further comprises a second clip tooth, extending inward from the second clip securement portion toward the second clip attachment portion; wherein the belt of the user fits between the second clip tooth and the second clip attachment portion to hold the magazine at the waist of the user.

* * * * *